United States Patent [19]

Palnik

[11] 4,452,684

[45] Jun. 5, 1984

[54] APPARATUS FOR SELECTIVE ELECTROLYTIC PLATING

[75] Inventor: Karl Palnik, Huntingdon Valley, Pa.

[73] Assignee: The Carolinch Company, Ivyland, Pa.

[21] Appl. No.: 474,320

[22] Filed: Mar. 11, 1983

[51] Int. Cl.[3] ..... C25D 17/00; C25D 17/28

[52] U.S. Cl. ..... 204/206; 204/224 R

[58] Field of Search ..... 204/206, 224 R

[56] References Cited

U.S. PATENT DOCUMENTS

| | | | |
|---|---|---|---|
| 936,472 | 10/1909 | Pfanhauser | 204/206 |
| 2,591,042 | 4/1952 | Berman | 204/202 |
| 3,661,752 | 5/1972 | Capper | 204/206 |
| 3,751,343 | 8/1973 | Macula | 204/224 R |
| 3,951,772 | 4/1976 | Bick | 204/198 |
| 4,119,499 | 10/1978 | Eidschun | 204/224 R |

*Primary Examiner*—T. M. Tufariello

*Attorney, Agent, or Firm*—Charles H. Lindrooth

[57] ABSTRACT

Selective electrolytic plating of small interconnected parts at high rates of production is disclosed. A porous hydrophobic material serves as the body of a brush member which has surfaces configured to transfer charged electrolytic solution to the selected surfaces of the parts being plated. Electrolytic solution is delivered under pressure to the interior of the body member.

16 Claims, 5 Drawing Figures

APPARATUS FOR SELECTIVE ELECTROLYTIC PLATING

FIELD OF THE INVENTION

This invention relates to the electrolytic plating of selected areas of metal pieces, especially pieces interconnected in strip form and more particularly, to the plating of parts with precious or noble metals by the so-called brush or selective application method.

BACKGROUND OF THE INVENTION

Brush plating of one metal onto another is a technique which has been in use for many years. Early electrolytic technique, and the technique frequently employed even today, involves the immersion of a part to be plated in an electrolyte bath. The part forms a negative electrode and ions of a metal to be deposited on the part are deposited on the part by the flow of current from an anode through the electroltye, ions of the plating metal being in solution in the electroltye. The terms brush or selective plating are used when the electrolytic solution is wicked up or otherwise transferred from a bath through the fabric of a felt-like covering of a tool called a brush. The brush has a positive charge and the part to be plated, which is negatively charged, is brought into contact with the surface of the brush by a rubbing action until the portion contacted is plated electrolytically.

Early brush plating involved use of a hand held tool acting as anode, the tool having its surface impregnated with electrolyte. The surface was brushed or rubbed against the oppositely charged area to be plated until a satisfactory finish was achieved. More recent applications have provided a fixed brush against which interconnected parts are brushed while being moved lengthwise of the brush surface. Electrolytic solution is wicked upwardly onto the brush surface from a bath located beneath the part.

In batch plating, a variety of problems arise in attempting to confine the plating to a relatively small region of a part. It can be readily understood that if the part is simply immersed in the bath, all portions immersed are plated, even though it may be desired to plate only one portion, such as one side of a part. Furthermore, since the ions in solution in the plating bath are used up in that part of the solution between the anode and the part being plated, it is necessary to rather vigorously agitate the solution. This agitation makes it virtually impossible to precisely control the depth of plating on a partially immersed part, at least if relatively rapid plating and efficient use of electrolytic solution is desired.

Although selective plating including plating on one side of a part is possible using prior art brush plating techniques, plating is a relatively slow process inasmuch as the rate of plating is dependent upon the speed at which the electrolyte is wicked up through the brush to the region of the brush against which the part is rubbed.

An in-depth explanation of various plating techniques is found in *Gold Plating Technology,* Frank H. Reid & William Goldie, Electrochemical Publications Limited, Ayr, Scotland, 1974.

In accordance with the invention, high speed selective plating by the brush method is accomplished using a brush comprised of a molded body member formed of a porous, hydrophobic material covered by a felt-like material. The electrolytic solution, which contains the plating metal in solution, is distributed through a conduit located interiorly of the brush and passes outwardly through small pores in the hydrophobic material until it covers the felt-like surface material. An anode screen is disposed immediately beneath the brush surface and imposes a uniform charge on the metal ions in the plating solution as the solution passes through the openings of the screen. In a preferred embodiment, used for plating a variety of sheet metal electrical connector parts, interconnected in strip form, the brush has at least one elongated planar side, at least one elongated acutely radius edge and desirably has at least one elongated curved surface which has a substantially larger radius than the acutely radiused edge. Means are provided for rubbing or brushing negatively charged parts to be plated lengthwise over a selected elongated surface or edge of the brush. Important objects achieved by the invention are rapid plating, selectively, of one side of a part, of selected regions of a part or of curved portions of a part. A related object and advantage is the application of plating material in precisely controlled amounts. Another advantage of the invention is capability of precision control of the depth or width of the plated portion of a part. Plating quality is extremely uniform as fresh plating solution is continuously delivered to the entire surface of the brush in controlled amounts.

Another important object and advantage of the invention is the substantial savings in the amount of precious metals used in the plating of small metal parts.

Still another object achieved with the invention is a substantial increase in production rates in the plating of small interconnected electronic or electrical parts.

A related object of the invention is an increase in the efficiency of utilization of electrolytic plating solutions.

The above and other objects and advantages of the invention will become apparent from the detailed description of the invention and from the accompanying drawings.

DETAILED DESCRIPTION OF THE ILLUSTRATIVE EMBODIMENT

Figure 1:
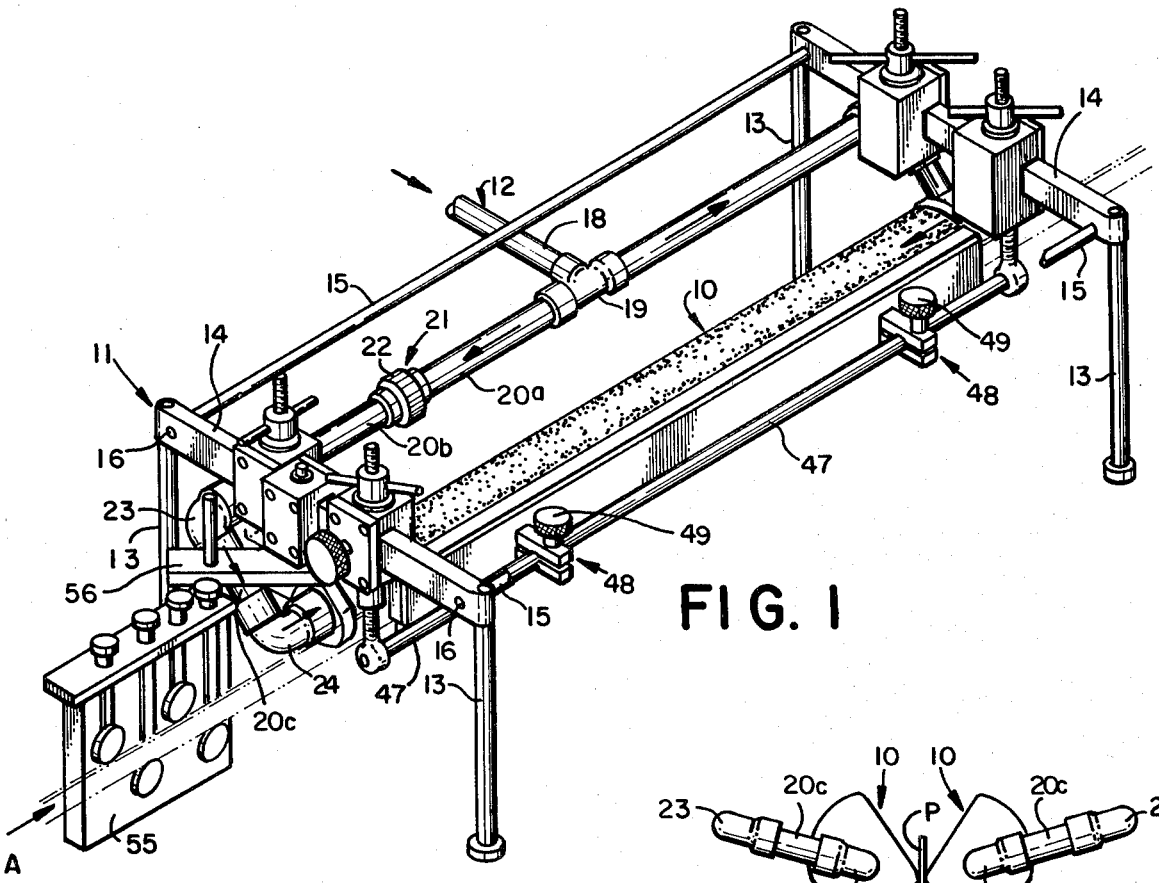
FIG. 1 is a perspective view of brush plating apparatus incorporating the teachings of the present invention.

Reference is first made to FIG. 1 which is an overall view illustrating apparatus and method incorporating the principles of the invention.

In summary, the apparatus shown comprises an elongated plating brush member 10 which is supported in an elongated tub, not shown, on a framework generally indicated by the reference character 11. Electrolytic solution is delivered under pressure to the interior of the plating brush member by means of a conduit system generally indicated by reference character 12. The body of the brush is of sufficient porosity that the solution flows outwardly onto the brush surface as will be described hereinafter.

Although the invention has theoretical application to the plating of metal parts in other forms, as illustrated it is primarily intended for use in the plating of flat or curved thin sheet metal pieces interconnected in strip form for fabrication purposes. Such pieces are commonly used in the fabrication of electronic or electrical components, portions of which are to be coated with a precious metal such as gold so that the regions to be coated are highly conductive and are immune from tarnish or corrosive attack. Usually only relatively small regions on each part need to be coated and the present invention is well suited to achievement of the goal of limiting the coating of precious metal to those areas of the part where it has utility. In the description to follow, the strip of metal is intended to be used for the fabrication of individual electronic components such as semiconductor chips and the electrical connectors on the chips are to be coated with gold to ensure high conductivity. The strip of parts is illustrated in broken lines in FIG. 1, the parts moving past the brush in the direction indicated by arrow A.

Framework 11 typically comprises spaced-apart support posts 13, two of which are located at each end of the plating equipment. Horizontally extending cross members 14 are connected to the tops of the posts at each end of the apparatus by any suitable means. The two pairs of support posts and cross members are interconnected by elongated rails 15 which may be bolted to the cross members 14 by machine bolts 16.

Conduit system 12 delivers the electrolytic solution to the interior of brush member 10 as will be described hereinafter. Typcially, the conduit system comprises a pipe 18 which leads to a tee 19 from which branch pipes 20 extend in opposite directions for connection to openings in the opposite ends of the brush member 10.

Figure 3:
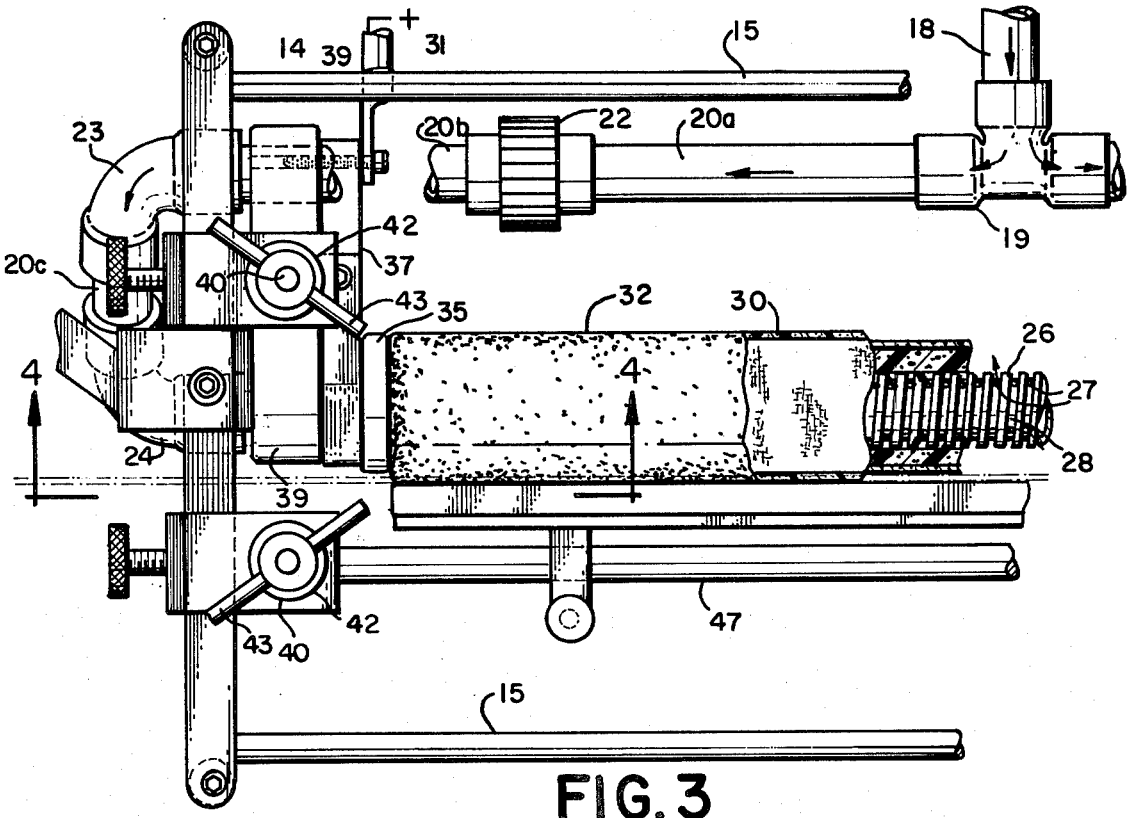
FIG. 3 is a plan view of the apparatus shown in FIGS. 1 and 2.
Figure 4:
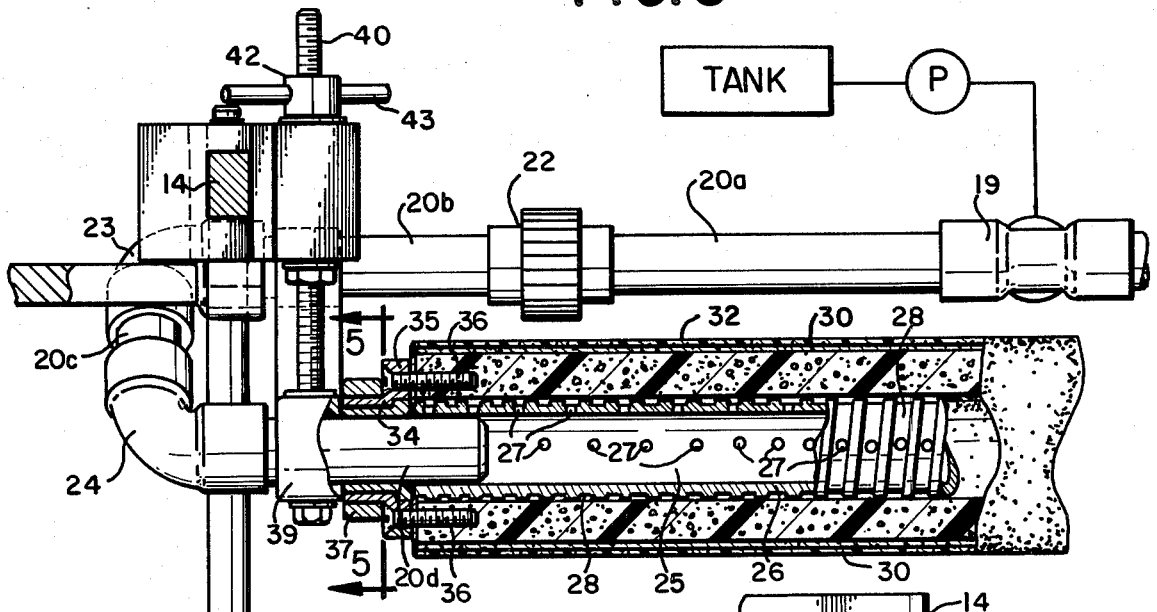
FIG. 4 is a sectional view taken on line 4—4 of FIG. 3.

Brush member 10, best seen in FIGS. 3 and 4, comprises a hollow elongated body portion 25 formed of a porous hydrophobic material. Although other materials may be employed, the material is preferably a molded polypropylene sold by a number of manufacturers, having pores uniformly dispersed throughout so that it is liquid pervious. Porosity of the material may vary somewhat. As a generalization, larger pores and greater pore density will permit faster plating rates but at the same time may result in more plating solution being deposited on the surface of a part than is necessary, making selective plating more difficult to control. In general, a material having the proper pore size and density for the application contemplated can be determined after a few field trials. Suitable molded porous polypropylenes are Porex Plastic, sold by Glassrock-Porex Division, Fairburn, Ga. 30213, Interflo Plastic, sold by Hedmex Chemical Corp. Brooklyn, N.Y. 11222 and a porous polypropylene sold by General Polymeric Corporation, 621 Franklin St. West Reading, Pa. 19611. Porous polypropylenes having pore sizes in the range of 100 to 200 micro inches in diameter produce excellent results.

As indicated above, the molded body member 25 is mounted on a distribution conduit 26 which runs lengthwise of the body member. The pipe sections 20(*d*), one of which is shown in FIG. 4, are fitted into the ends of distribution conduit 26. Suitable seals are provided at the joints between the pipe sections 20(*d*) and the distribution conduit so that the joints are fluid tight.

In order to assure a uniform distribution of electrolyte solution into the porous body member 25, a plurality of spaced openings 27 extend through the wall of the conduit 26 into a spiral groove 28, so that fluid flowing from the distribution conduit passes through the openings 28 and tends to circulate through and fill the spiral grooves before it enters the body portion 25. The arrangement assures a uniform distribution of electrolyte to the body portion.

Figure 2A:
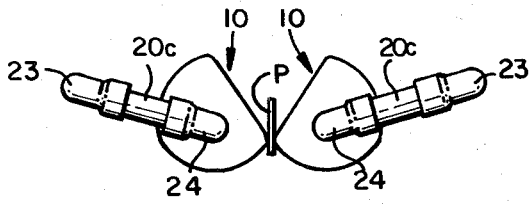
FIG. 2*a* is an end view similar to FIG. 2, showing an alternative configuration of the invention, with portions of apparatus eliminated to clarify the illustration.
Figure 2:
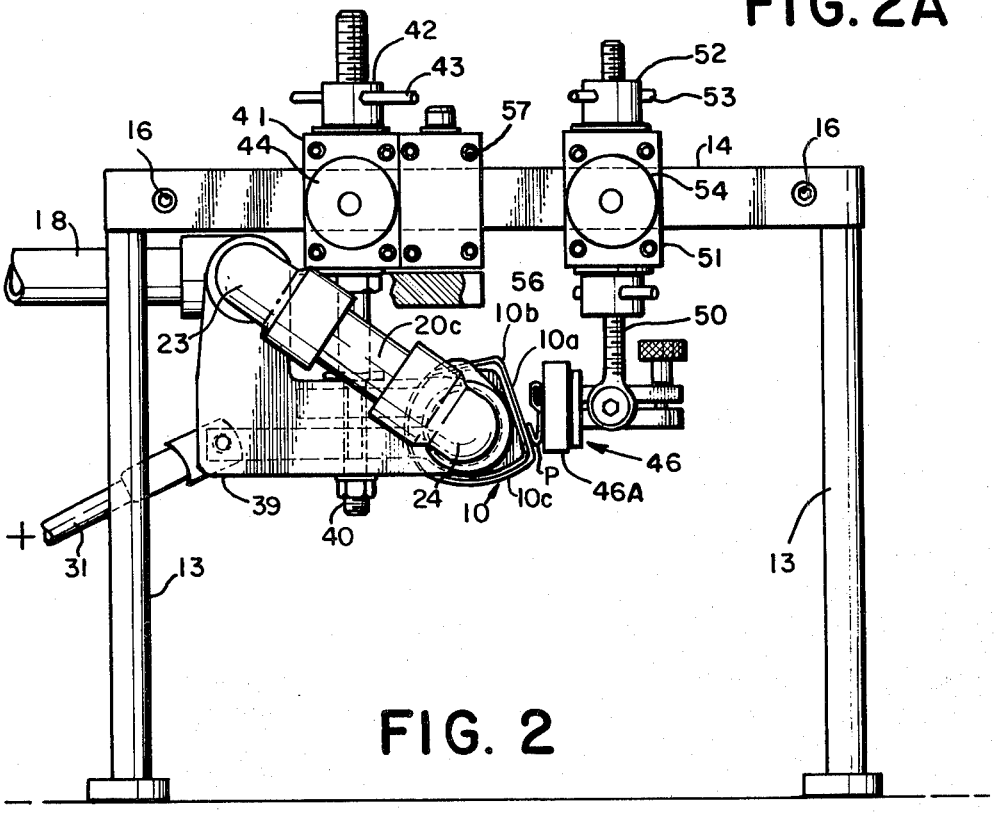
FIG. 2 is an end view of the apparatus illustrated in FIG. 1.

Brush member 10 further comprises anode 30 which preferably is formed of porous platinum sheet or screen material and is inter-connected to the positive side of a DC power source by a lead schematically represented in FIG. 2 and identified by reference character 31. Screen 30 covers all portions of the exterior surface of the body member of the brush so that the metal in solution is ionized as it passes out of the body member. The brush further includes a felt-like covering 32 which covers anode 30.

Figure 5:
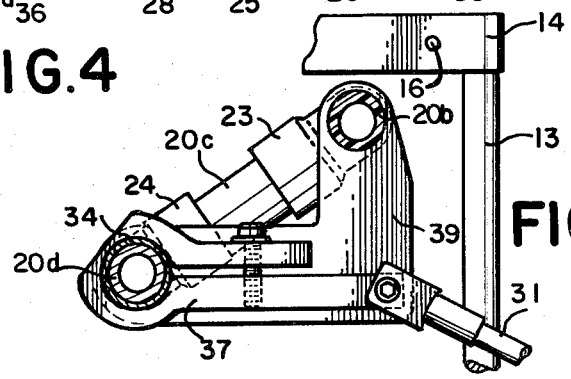
FIG. 5 is a fragmentary sectional view taken on line 5—5 of FIG. 4.

Preferably brush 10 is rotatable about its long axis so that surfaces of different configuration can be positioned for contact with the parts being plated. Although any suitable means may be employed, a collar 34 is preferably mounted on each end of the distribution conduit 26. The collar has a flange 35 through which screws 36 are threaded into the porous polypropylene body material. A clamp 37, FIG. 5, fitted over collar 34 and is tightened by a machine bolt 37*a* to hold the brush in the desired position. Clamp 37 and collar 34 are electrically conductive and connected to lead 31 so as to provide an electrical connection to the anode screen 30. At least one pipe section 20 is nonconductive so that the brush is electrically insulated from ground.

During set-up of the apparatus, it is desirable that there be provision for means for limited movement of the brush member 10 towards and away from the path of parts, one part being identified by the reference letter P in FIG. 2.

With reference to FIGS. 2 and 3, an L-shaped support 39 is mounted at one end on pipe section 20(*b*) and the opposite end mounted on pipe section 20(*d*). An adjusting screw 40 is threadedly mounted in a support block 41 which is slidably mounted on horizontal bar 14. The lower end of adjusting screw 40 passes through a hole in the lower arm of the support 39. A nut 42 is threaded onto the upper end of adjusting screw 40 and is preferably provided with handles 43 by which the nut is rotated thereby raising and lowering the threaded adjusting screw. A nut 40*a* on the bottom of the screw bears against the underside of support 39 and imparts movement thereto as the adjusting screw is raised.

Preferably, the support blocks 41 are locked in adjusted position on horizontal rails 14 by means of set screws 44 which facilitate the approximate positioning of the brush member relative to the path of parts to be plated. Thus, during set up the brush member may be moved both vertically and horizontally by means of the apparatus above identified.

In FIG. 2, two brush members are mounted in side-by-side relationship within frame 11 so that both sides of part P may be simultaneously plated. In most instances it is only necessary to plate a surface on one side of a part and for this purpose a guide bar 46 is mounted adjacent to the brush so as to guide and lightly press the parts against the brush surface. The guide bar may be removeably mounted on a rail 47 and extends lengthwise of the brush to lightly press parts being plated against the brush surface as they are moved lengthwise thereof. Guide bar 46 has a non-conductive surface 46(*a*) and is adjustably positionable for movement towards and away from the path of movement of parts P. The guide bar is preferably mounted on a rail 47 by any suitable means such as pairs of jaws 48 which lock the guide bar to rail 47 by means of set screws 49. Rail 47 is in turn carried by adjusting screws 50 mounted in support blocks 51 on horizontal bars 14. Nuts 52 having handles 53, and set screws 54 provide for adjustment of the support blocks and guide bar to the desired position adjacent the path of travel of parts. When plating on two sides of a part, the guide bar is removed and replaced with a second brush as schematically illustrated in FIG. 2A, the second brush being mounted in the same manner illustrated in FIGS. 1–4.

In use, electrolytic solution containing the metal to be plated is pumped through pipe 18 to the interior of the brush through pipes 20. The solution flows through the openings in the walls of distribution tube 26 from which it fills the spiral grooves 27 and progresses radially outwardly through the porous body, through the anode screen 30 to the felt-like covering 32.

As can best be seen upon reference to FIG. 2, in a preferred form, the brush has at least one elongated planar surface 10(*a*), an acutely radiused edge surface 10(*b*) and at least one surface of relatively large radius 10(*c*). The surface with which it is intended to brush parts is moved into the path of travel of the parts by loosening clamp 37 and rotating the brush about its longitudinal axis to the desired position. The brush is then fixed in position immediately adjacent the path of travel of parts by tightening of the clamp 37 and adjustment of screw 40. The strip of interconnected parts indicated schematically in broken lines in FIG. 1 is placed between the brush surface and guide bar 46 so that the surface to be plated on each part is brushed against the appropriate surface of the brush covering 32 as the parts progress in the direction of arrow A in FIG. 1.

The profile of one part P having a plurality of upturned terminal portions is shown in FIG. 2. The terminal portions are plated on one side only on contact with the metallic ions emerging from surface 10*a* of the brush 10. Plating occurs as the parts, which are negatively charged, are moved continuously in the direction extending lengthwise of the brush by feed mechanism including a parts guide 55 best seen in FIG. 1. Although other support means may be employed for the parts guide, a bar 56 connected to the bottom of a block 57 provides support in the embodiment of FIGS. 1–5.

Plating solution not used, together with the spent solution, accumulates in a tub or reservoir schematically represented in FIG. 2 and located immediately beneath the apparatus. Recirculation means and means for replenishing the spent solution are provided for recirculation of solution back to inlet pipe 18.

It should be evident on reference to FIG. 2 that relatively large surface areas may be plated by orienting the brush member with flat surface 10(*a*) parallel to the path of travel of the parts and in contact with the surface being plated. By relative vertical adjustment of flat surface 10(*a*) and clamping bar 46, strip plating of a top or bottom edge of a part may be performed. A narrow strip intermediate the top and bottom edges of the parts may be plated by rotation of the brush member so that the acutely radiused edge 10(*b*) is brushed by the section of the parts to be plated. Curved surfaces may be plated by utilization of one of the radiused portions of the brush member such as surface 10(*c*). Brushes having other cross-sectional shapes to facilitate the plating of parts having other configurations may also be employed. Total or strip plating of both sides of parts may be achieved by passing the parts between two brushes with one surface of each brush being in contact with a surface of the part to be plated as is shown in FIG. 2(*a*).

It has been found that the use of a hydrophobic material for the body of the brush is an important feature of the invention in that it results in a very even layer of plating material being applied to the parts being plated. Exceptionally high plating rates may be achieved using the teachings of the invention. As an example, electronic parts fed at a rate of 15 feet per minute and brushed at that feed rate lengthwise of a brush member of 36 inches in length are continuously plated with a coating of gold having a thickness of 50 micro inches. Wastage of plating solution is practically eliminated and the width of the area being plated on a part can be precisely controlled. Plating can be easily limited to one side of a part only and in edge plating, there is substantially no tendency for the plating solution to wick upwardly so that it plates on undesired or non-functional areas of parts being plated.

I claim:

1. Apparatus for the electroplating of parts, wherein the parts are interconnected in the form of elongated strip material wherein the metallic strip material is moved in a path which extends lengthwise of the apparatus, said apparatus comprising a plating brush means comprised of an elongated body member having its long axis extended parallel to the path of movement of the strip material, said body member having a substantially uniform cross-section throughout its length whereby a brush plating surface is positioned adjacent and in parallel relationship to the path of travel, said body member being composed of a hydrophobic material having interconnected pores dispersed throughout, means including a centrally located distribution conduit extending the length of the body for distributing liquid electrolytic plating solution under pressure into the pores of the body member along the length thereof, said plating brush means further including anodic means for imposing a uniform charge on the liquid plating solution passing from the distribution means to the plating surface and means for moving the metallic strip material from one end to the other of said lengthwise extended body member in contact with said brush plating surface.

2. Apparatus according to claim 1 wherein said distribution conduit has an outer wall surface with spiral grooving thereon and spaced openings providing passage ways from the inside of the conduit to the spiral grooving, the spiral grooving providing passage ways for uniform distribution of plating solution to the body member.

3. Apparatus according to claim 1 further including a guide means extending lengthwise of the brush for pressing the strip material against the applicator cover.

4. Apparatus according to claim 1 further including a second brush, means mounting said second brush in side-by-side relationship with said first named brush; said brushes being contiguous to the path of the metallic strip material for electrolytic plating of opposite sides of said strip material.

5. Apparatus according to claim 4 wherein said distribution conduit has an outer wall surface with spiral grooving thereon and spaced openings providing passage ways from the inside of the conduit to the spiral grooving, the spiral grooving providing passage ways for uniform distribution of plating solution to the body member.

6. Apparatus according to claim 1 wherein said brush has at least one elongated, substantially planar side wall and an acutely radiused edge portion, said substantially planar side wall and said acutely radiused edge portion being parallel to the long axis of the body member.

7. Apparatus accordng to claim 6 further including means for adjustably rotating said brush member whereby a selected surface may be brought into contiguity with the path of the metallic strip material.

8. Apparatus according to claim 2 further including means for recirculating unused plating solution from the surface of the brush to the distribution conduit.

9. Apparatus according to claim 1 wherein said anodic means comprises a porous screen covering of substantially uniform thickness surrounding the side walls of said body, and an absorbent covering for said screen.

10. Apparatus according to claim 9 wherein said body member has a non-circular cross section.

11. Apparatus according to claim 1 wherein said body member is comprised of molded polypropylene.

12. Apparatus according to claim 1 wherein said distribution conduit has an outer wall surface with spiral grooving thereon, and spaced passages extending from the inside of the conduit to the spiral grooving.

13. Apparatus according to claim 1 wherein said body member is comprised of a molded plastic material.

14. Electroplating apparatus for transferring a coating of metal to an elongated metallic strip material wherein the strip material is moved in a path extending lengthwise of the apparatus; comprising a brush, said brush being composed of an elongated body member having its long axis extending in parallel to the path of movement of the strip material and having a brush plating surface adjacent to and in parallel relation with the path, said body member being composed of a microporous, hydrophobic synthetic resinous material, a centrally located distribution conduit extended lengthwise through the body member, said distribution conduit having circumferentially spaced openings distributed lengthwise thereof for passage of electrolyte solution uniformly through said hydrophobic material, means for moving the metallic strip material lengthwise of the brush with the parts in contact with the plating surface and plating circuit means comprising an anode and cathode for transferring uniformly charged plating solution from the brush member to the said metallic strip.

15. Electroplating apparatus according to claim 14 wherein said brush member is of non-circular cross-section.

16. Electroplating apparatus according to claim 15 wherein said brush plating surfaces comprise at least one elongated planar side wall and an acutely radiused edge portion, said substantially planar side wall and said acutely radiused edge portion being in parallel to the long axis of the body member, and means for adjustably rotating said brush whereby a selected brush plating surface may be brought into contiguous relationship with the path of the metallic strip material.

* * * * *